US006113016A

United States Patent [19]

Vedefors

[11] Patent Number: 6,113,016

[45] Date of Patent: Sep. 5, 2000

[54] ARRANGEMENT FOR DISINTEGRATION OF SUBSTANCES

[76] Inventor: Kent Vedefors, Brahegatan 22, 563 32 Gränna, Sweden

[21] Appl. No.: 09/407,227

[22] Filed: Sep. 27, 1999

[30] Foreign Application Priority Data

Sep. 6, 1999 [SE] Sweden ..... 9903141

[51] Int. Cl.[7] ..... B02C 18/06; B02C 18/24

[52] U.S. Cl. ..... 241/169.1; 241/199.9; 241/199.12

[58] Field of Search ..... 241/168, 169.1, 241/169.2, 199.9, 199.12

[56] References Cited

U.S. PATENT DOCUMENTS

| | | | |
|---|---|---|---|
| 4,121,775 | 10/1978 | Roseberg et al. | 241/30 |
| 5,156,084 | 10/1992 | Lin | 241/169.1 X |
| 5,533,801 | 7/1996 | Safont et al. | 241/169.12 X |
| 5,931,397 | 8/1999 | Herman et al. | 241/169.1 |
| 5,960,709 | 10/1999 | Yip | 241/199.12 X |
| 6,035,771 | 3/2000 | Conran et al. | 241/199.12 X |

*Primary Examiner*—John M. Husar
*Attorney, Agent, or Firm*—Fasth Law Offices; Rolf Fasth

[57] ABSTRACT

Arrangement for disintegration of substances, preferably from the vegetable and animal kingdoms such as fruits, vegetables, corn and meat products is described. It includes a stand (1) in which a first axle (2) is rotatably attached (3), and driven by a driving source (0) such as a combustion engine, an electric motor, or another driving source. The first axle (2) is associated with a driving link (4), in which a wheel (5) is rotatably attached (6) about a second axle (7) and disposed a radial distance from the first axle (2). The wheel has outer grip elements (8), preferably cogs, disposed in the periphery of the wheel, that cooperates with inner grip elements (10), preferably cog segments, along a symmetrical rotation path (9) of the stand (1). When the first axle (2) rotates, the driving link 4 causes the wheel 5 to rotate. A circular knife member (11) is attached to the wheel 5 and is coaxial with the wheel, the wheel cooperates with a rotation symmetrical radial holding member (12) and is coaxial with the first axle (2), and a substantially plane axial holding member (13). A funnel member (14, 0) is included for adding substances to be disintegrated.

10 Claims, 4 Drawing Sheets

FIG. 1A
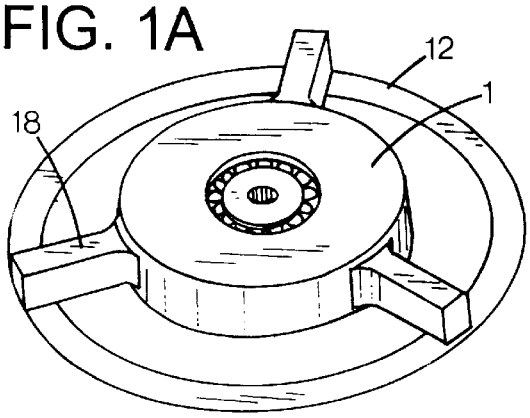
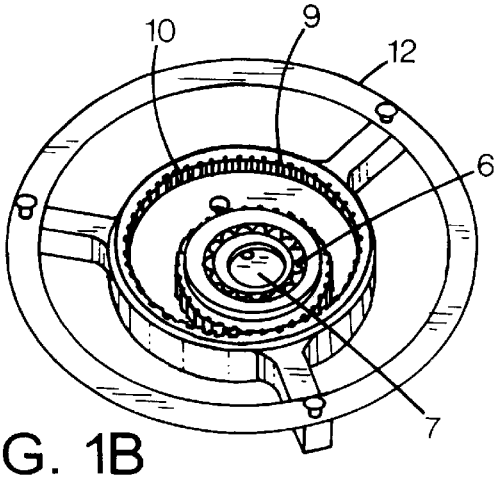
FIG. 1B
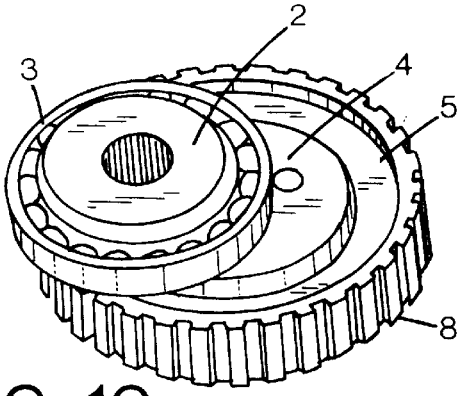
FIG. 1C
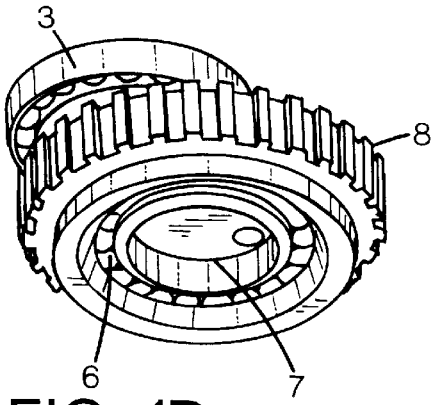
FIG. 1D
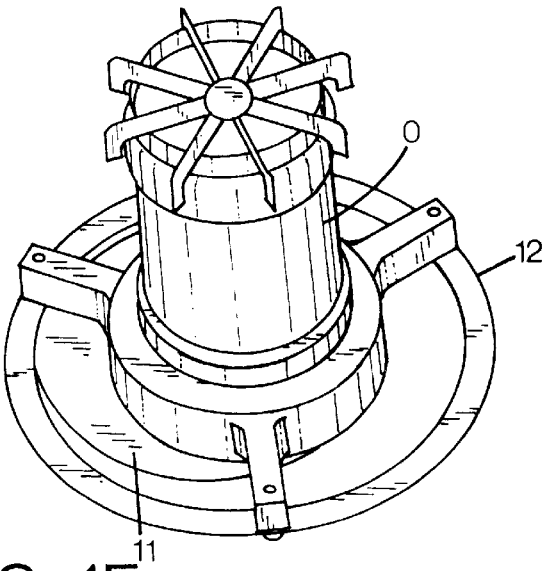
FIG. 1E
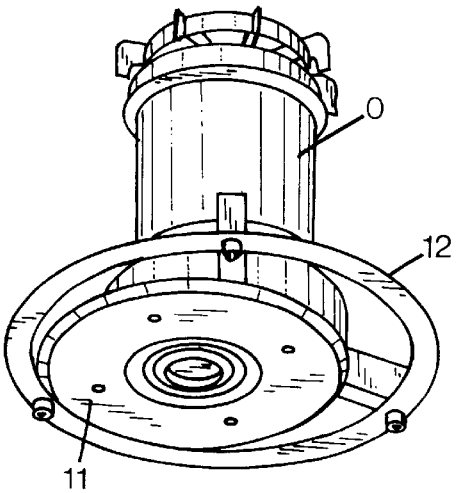
FIG. 1F

ARRANGEMENT FOR DISINTEGRATION OF SUBSTANCES

BACKGROUND AND SUMMARY OF THE INVENTION

The present invention relates of an arrangement for disintegrating substances, preferably from the vegetable and animal kingdoms such as fruits, vegetables, corn and meat products.

The object of the present invention is therefore to achieve an arrangement of the type mentioned above, that is suitable as a compost device for disintegration of fruit, potatoes etc. when predetermined bit sizes are desired.

The invention is described below with reference to the attached schematical drawings, in which

BRIEF DESCRIPTION OF THE DRAWINGS

FIGS. 1A–1F show perspective views of the components that are common for many of the embodiments of the arrangement according to the invention, FIG. 5 shows the same object as in FIG. 3 but the outer housing is removed and it is seen from below at an angle, while

DETAILED DESCRIPTION

Figure 2A:
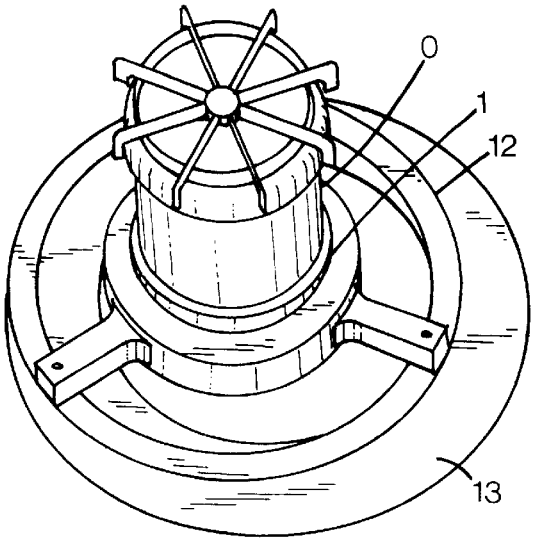
FIGS. 2A–2C show perspective views of a first embodiment of the arrangement according to the invention.
Figure 2B:
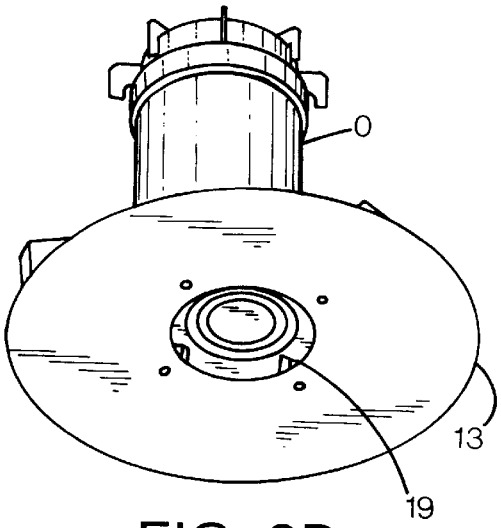
Figure 2C:
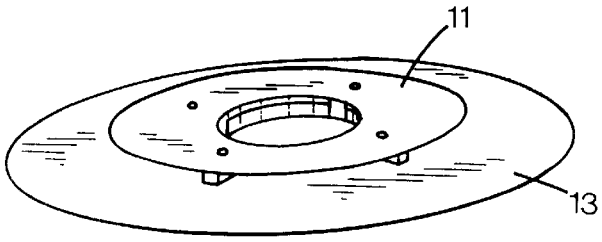
Figure 3:
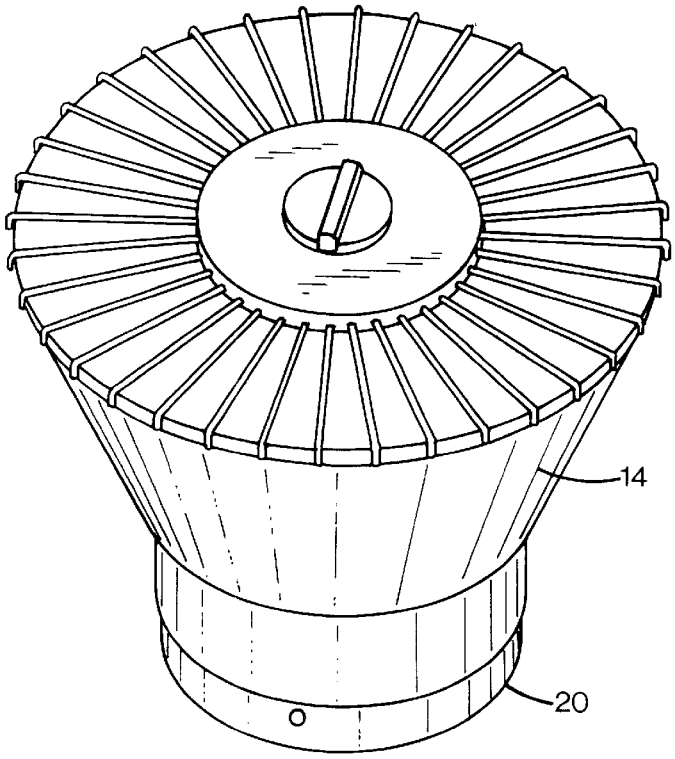
FIG. 3 shows a perspective view of an arrangement according to the invention.
Figure 4:
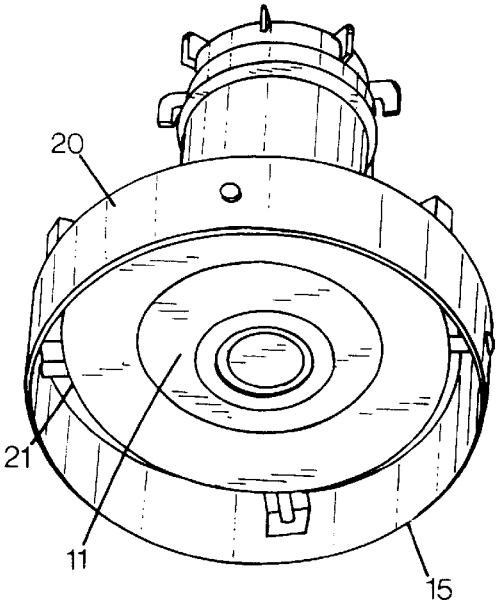
FIG. 4 shows the same object as in FIG. 3 but the outer housing is removed and it is seen from below at an angle.
Figure 5:
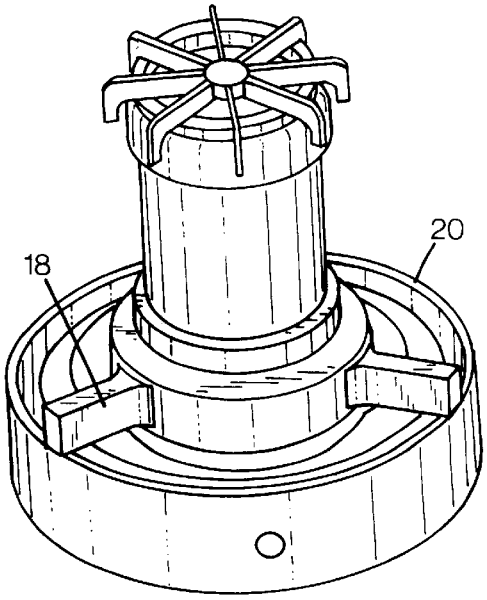
Figure 6A:
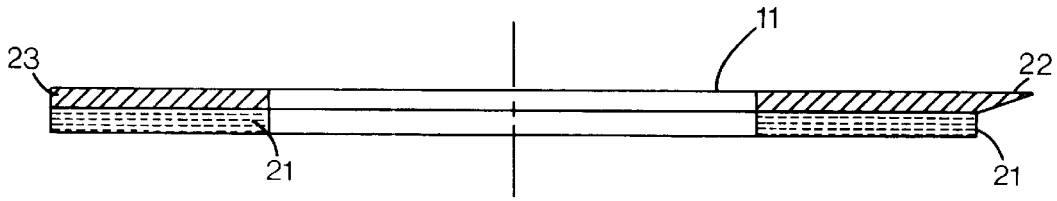
FIGS. 6A–6D show different embodiments of a knife member that is included in the arrangement according to the invention.
Figure 6B:
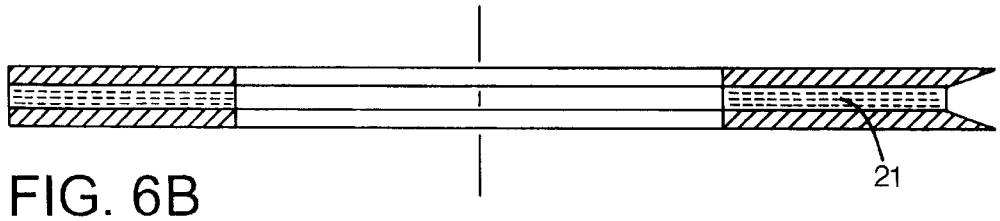
Figure 6C:
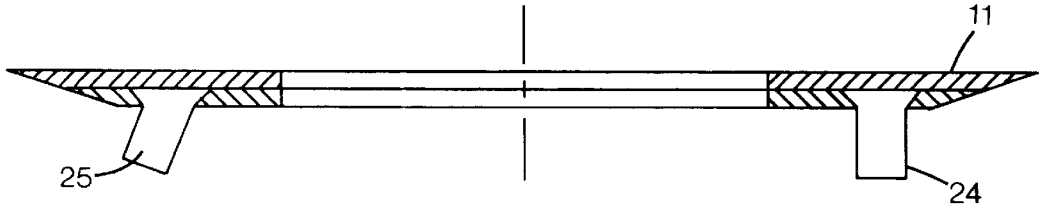

An example of the design of the common components for the various embodiments of the arrangement of the invention is shown in FIGS. 1A–1F. A stand shown as 1, includes three radial holders 18. A first axle is centrally disposed in the stand 1 and rotatably engaging a bearing 3. This axle is driven by a driving source 0 which should be an electric motor, a combustion engine or an external driving source with a transmission, for example, a belt driven source. The first axle 2 is associated with a driving link 4, in this case in the form of a body that is rotationally symmetrical. A wheel 5 is disposed at a radial distance from the first axle 2 and the wheel is rotatably attached about a bearing 6 and is thus rotatably about a second axle 7. An outer grip element 8 is disposed in the periphery of the wheel, in this case in the form of cogs that are cooperating with corresponding inner grip elements 10 along a symmetrical rotation path 9 of the stand 1. When the first axle 2 rotates, the driving link 4 causes the wheel 5 to rotate. A circular knife member 11 in attached to the wheel 5 and is coaxial with the wheel. The wheel cooperates with a rotation symmetrical radial holding member 12 and is coaxial with the first axle 2. As shown in FIGS. 3 and 5, an outer housing 14, that is upwardly open, is placed on the stand 1. The space between these housings includes a funnel shaped for the addition of substances that are to be disintegrated or spread out, such as fertilizers. The stand 1 includes three radial holders 18 in which a rotationally cylindrical lower housing 20 is attached, as is apparent from FIGS. 3, 4 and 5. The knife member 11 can be permanently attached to the wheel 6, or in an alternative embodiment be attached to the wheel 5 so that it can be released therefrom and be freely rotatable about the second axle 7. In this embodiment, the incoming substance is caught between the knife member and the radial holding member. The axial holding member can either rotate with the knife member, or be attached to the stand. In preferred embodiments the axial holding member is designed with a central, circular opening, through which the disintegrated substances for the most part may exit. In FIGS. 2*b* and 2*c* the axial holding member is shown with a central opening 19 and in FIG. 4 an arrangement that has an axial holding member in the form of a ring disc 15 that is attached to the stand 1. In this case the central opening has a diameter that is smaller than the knife member and its eccentric path of movement. This embodiment has the advantage that the knife member does not fall out from the arrangement if it is disconnected. The embodiment also prevent injuries to fingers or hands. The diameter of the holding member is greater than the diameter of the knife member. A gap opening 21 that exists between the axial holding member 15 and the lower part 20 of the outer housing is relatively small. The outgoing substances can pass through the gap opening 21 and through the opening inside the ring disc 15. The axial holding member can be adjusted in an axial direction so that it is possible to adjust the cutting size of the outgoing substance. The knife member may be designed in different ways as is shown in FIGS. 6A–6D. It can be provided with a dampening bearing 21, such as polyurethane that is shown in FIGS. 6A and 6B. The latter figure shows an embodiment that has two knife member associated with a dampening bearing. The periphery of the knife member can be designed with a radially sharp cross section or be rotational cylindrically designed 23. In FIG. 6C, an embodiment of the edges 24, 25 is shown that protrudes downwardly. The edges can be removably attached or be integrated parts of the knife member. They work so that they cut the substances into slices that the circular knife member cuts initially. It is thus possible to produce sliced vegetables or fried potatoes with this embodiment.

Figure 6D:
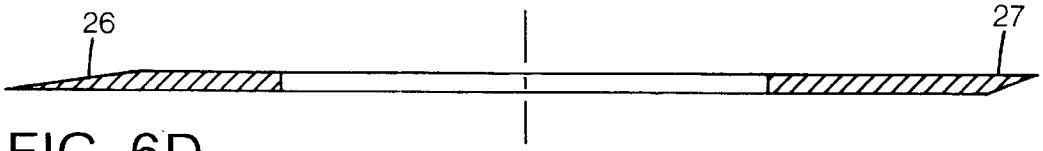

By, as is indicated in FIG. 6D, coating the upper part of the knife member completely or partly with an abrasive material 26, the arrangement can be used to peel or grind for example, potatoes or root crops. By adding a continuous flow of, for example, potatoes one can with the assistance of the abrasive surface or the pattern of movement of the knife member cause the potatoes to turn and be peeled. By selecting the right dimensions of the parts that are included in the arrangement and by adjusting the rotational speed, one can accomplish a complete peeling within one lap of the driving first axle. The substance can enter and exit practically within one lap. The peel can exit through the gap opening.

The knife member can also, according to FIG. 6D, be designed with peripheral teeth 27 that tear the incoming substance apart.

The radial holding member can be shaped to include an inwardly directed knife edge or tooth or a combination thereof. The three segments of the radial holding member 12 that are disposed between the three holders 18 can thus be equipped with an even edge, an inwardly directed knife edge and tooth, respectively.

I claim:

1. An arrangement for disintegrating substances, comprising:

a stand having inner grip elements disposed at a periphery of the stand;

a first axle rotatably attached to the stand;

a driving source in operative engagement with the first axle;

a driving link in operative engagement with the first axle so that when the first axle rotates the driving link is caused to rotate;

a wheel disposed a radial distance from the first axle, the wheel having outer grip elements at a periphery of the wheel, the outer grip elements in operative engagement with the inner grip elements of the stand to form a symmetrical rotation path with the inner grip elements, the wheel in operative engagement with the driving link so that when the driving link rotates the wheel is caused to rotate;

a circular knife member attached to the wheel and coaxial therewith, a symmetrical radial holding member in operative engagement with the knife member;

a substantially flat holding member in operative engagement with the knife member; and a funnel member attached to the stand for receiving the substances to be disintegrated.

2. The arrangement according to claim 1 wherein the knife member is releasably attached to the wheel and freely rotatable about a second axle.

3. The arrangement according to claim 1 wherein the flat holding member is rotatable about a second axle and coaxial with the knife member.

4. The arrangement according to claim 1 wherein the flat holding member comprises a ring disc.

5. The arrangement according to claim 1 wherein the axial holding member is comprises a ring disc that is attached to the stand.

6. The arrangement according to claim 1 wherein the flat holding member is adjustable in the axial direction.

7. The arrangement according to claim 1 wherein the knife member has an underside that has axially directed edges.

8. The arrangement according to claim 1 wherein the knife member is coated with a dampening material on an underside thereof.

9. The arrangement according to claim 1 wherein the knife member is coated with an abrasive material.

10. The arrangement according to claim 1 wherein the radial holding member comprises an inwardly directed knife edge.

* * * * *